United States Patent [19]

Reist

[11] Patent Number: 4,768,768

[45] Date of Patent: Sep. 6, 1988

[54] APPARATUS FOR PROCESSING PRINTED PRODUCTS USING A MOBILE WINDING AND UNWINDING BAND STORAGE UNIT

[75] Inventor: Walter Reist, Hinwil, Switzerland

[73] Assignee: Ferag AG, Hinwil, Switzerland

[21] Appl. No.: 42,238

[22] Filed: Apr. 24, 1987

[30] Foreign Application Priority Data

Apr. 30, 1986 [CH] Switzerland ..... 1788/86

[51] Int. Cl.[4] ..... B65H 39/08

[52] U.S. Cl. ..... 270/60; 242/59; 53/118; 271/151; 271/216

[58] Field of Search ..... 270/54, 60; 242/59, 242/159; 271/151, 216; 53/118

[56] References Cited

U.S. PATENT DOCUMENTS

| | | | |
|---|---|---|---|
| 4,116,427 | 9/1978 | Muller | 270/54 |
| 4,438,618 | 3/1984 | Honegger | 242/59 |
| 4,523,751 | 6/1985 | Merkli | 270/60 |
| 4,587,790 | 5/1986 | Muller | 53/118 |
| 4,676,496 | 6/1987 | Honegger | 242/59 X |

*Primary Examiner*—E. H. Eickholt

*Attorney, Agent, or Firm*—Werner W. Kleeman

[57] ABSTRACT

The winding core mounted to be rotatable and removable in a mobile storage unit, is placed into rotation by means of a drive roll which engages at the outer surface or circumference of the widing core or, as the case may be, the wound product package forming thereupon. In the mobile storage unit there is likewise removably arranged a winding band spool or reel which is also driven at its outer surface or circumference. For this purpose there is likewise provided a driven drive roll. By virtue of such circumferential drives for the winding core and, as the case may be, the wound product package, and equally the winding band spool or reel the mobile storage units can be of simple construction. This also enables the mounting or support arrangement for the winding core and the mounting or support arrangement for the winding band spool or reel to be structured such that the winding core and the winding band spool can be easily removed from the related mobile storage unit.

22 Claims, 6 Drawing Sheets

Fig. 2
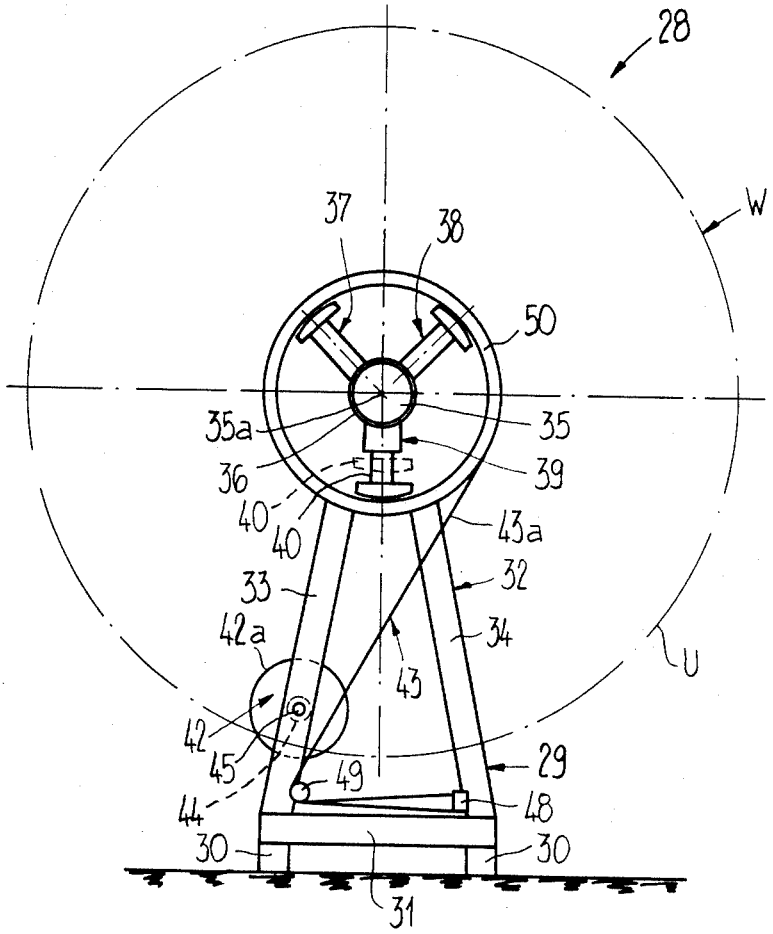
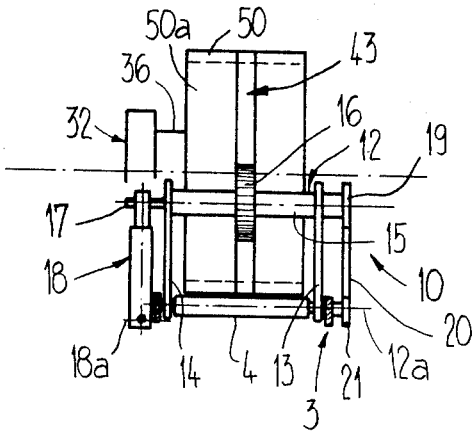
Fig. 5

APPARATUS FOR PROCESSING PRINTED PRODUCTS USING A MOBILE WINDING AND UNWINDING BAND STORAGE UNIT

CROSS-REFERENCE TO RELATED APPLICATION

This application is related to the commonly assigned, copending U.S. application Ser. No. 07/042,240, filed Apr. 24, 1987, entitled "METHOD AND APPARATUS FOR PROCESSING FLAT PRODUCTS, ESPECIALLY PRINTED PRODUCTS".

BACKGROUND OF THE INVENTION

The present invention relates to a new and improved construction of apparatus for processing of printed products, such as newspapers, periodicals and the like, particularly printed products arriving in an imbricated formation. The invention also concerns an improved mobile storage unit for use in such product processing apparatus.

Generally speaking, the processing apparatus of the present development is of the type comprising a number of mobile storage units, wherein each such mobile storage unit comprises a hollow substantially cylindrical winding core or mandrel rotatably mounted in a frame or frame member as well as a winding band spool or reel for a winding band or strap which can be connected with the winding core. This winding band spool or reel is likewise rotatably mounted in the frame or frame member. Furthermore, there is provided at least one stationary wind-up station at which there can be operatively coupled in each case one of the mobile storage units and which possesses infeed means for infeeding or delivering the printed products to the winding core or, as the case may be, the wound product package which is formed upon such winding core. Furthermore, the processing apparatus is provided with a drive arrangement or drive means for rotating the winding core or, as the case may be, the wound product package which is formed thereupon.

With heretofore known apparatuses of this type both the winding core as well as also the winding band spool or reel are fixedly arranged in the transportable frame or frame member. Significant in this regard are German Patent Publication No. 3,236,866 and the corresponding British Patent No. 2,107,681 and the cognate U.S. Pat. No. 4,587,790, granted May 17, 1986 and the European Published Patent Application No. 0,135,080, published Mar. 27, 1985 and the cognate U.S. Pat. No. 4,523,751, granted June 18, 1985. Each frame possesses coupling devices for coupling the winding core and the winding band spool with a drive unit which is arranged in the stationary wind-up station.

These heretofore known mobile storage units are thus complicated in construction and therefore relatively expensive. This means that as far as the printing plane or establishment or other user of such equipment is concerned there is required an appreciable capital investment inasmuch as a large number of such storage units are required. Furthermore, there also must be taken into consideration that in the event there is undertaken an intermediate storage of the wound product package the associated storage unit likewise must remain in the intermediate storage facility and therefore during this time not available for further use.

In the aforementined European Published Patent Application No. 0,135,080 and the cognate U.S. Pat. No. 4,523,751, granted June 18, 1985, there is disclosed a construction in which the winding core or, as the case may be, the wound product package which is being formed thereupon, is driven at its outer surface or circumference. This means that the storage unit need not be provided with a coupling arrangement for coupling the winding core with the stationary drive, but nonetheless there still exists with such prior art construction the previously enumerated drawbacks.

In European Published Patent Application No. 0,149,058 and the cognate U.S. Pat. No. 4,676,496 granted June 30, 1987, and entitled "METHOD AND APPARATUS FOR SUPPLYING PRINTED PRODUCTS TO A CONTINUOUSLY OPERATING PROCESSING LINE", there are disclosed travelling or mobile frames which are loaded externally of an unwinding station with a full or completely wound product package which has been prepared for undergoing an unwinding operation. Thereafter, in each case a frame together with the wound product package is displaced into the unwinding station where there is accomplished coupling thereof with a drive arranged in the unwinding station. In the frame there is provided, apart from the mounting or support arrangement for a wound product package and a winding band spool, also an outfeed device for the printed products which have been unreeled or unwound from the wound product package. However, such arrangement also renders this design complicated. Moreover, these frames, by virtue of their construction, are not suitable for winding-up printed products into a wound product package.

SUMMARY OF THE INVENTION

Therefore, with the foregoing in mind it is a primary object of the present invention to provide a new and improved construction of an apparatus for processing printed products, such as newspapers, periodicals and the like, in a manner which is not afflicted with the aforementioned drawbacks and shortcomings of the prior art constructions.

Another and more specific object of the present invention aims at the provision of a new and improved construction of processing apparatus for printed products, especially although not exclusively newspapers, periodicals and the like, wherein with a minimum number of mobile storage units there are afforded expanded fields of application.

Still a further significant object of the present invention is directed to a new and improved construction of a mobile storage unit for use in the processing apparatus of the present invention.

Yet another noteworthy object of the present invention is to provide an improved construction of apparatus for processing printed products in a highly reliable and efficient manner, which processing apparatus is relatively simple in construction and design, quite economical to manufacture, highly reliable in operation, not readily subject to breakdown or malfunction, and requires a minimum of maintenance and servicing.

Now in order to implement these and still further objects of the invention, which will become more readily apparent as the description proceeds, the apparatus for processing printed products, such as newspapers, periodicals and the like, as contemplated by the present development, is manifested by the features that both the winding cores as well as also the winding band spools are removably or detachably mounted in the frames or frame members.

As indicated previously the invention is not only concerned with the aforementioned processing apparatus but also to an improved construction of mobile storage units for use in such processing apparatus. Each such mobile storage unit comprises a frame or frame member for the rotatable mounting or support of a hollow substantially cylindrical winding core or mandrel as well as for the mounting or support of a winding band spool or reel for a winding band or strap. According to important aspects of the present invention each such mobile storage unit comprises a first mounting or support means for the detachable or removable mounting of a winding core and a second mounting or support means for the removable or detachable mounting of an associated winding band spool or reel.

Since there is afforded the possibility of removing the wound product package and also the winding band spool or reel from the frame or frame member, the mobile storage units are not compelled to remain together with the wound product packages in an intermediate storage or storage area. Quite to the contrary, it is possible to further employ the storage units for the formation of new wound product packages during such time as the finished or fully wound product packages are intermediately or temporarily stored. The mobile storage units thus can be continuously employed for creating new wound product packages and need not be rendered temporarily non-functional or blocked from further utilization by remaining in the intermediate storages or storage areas.

A particular simple construction of the storage unit is realized when both the winding core or, as the case may be, the wound product package formed thereupon, as well as also the winding band spool or reel are driven at their outer surface or circumference. With such design it is not necessary to provide at the mobile storage unit itself a coupling arrangement or coupling means for coupling of the winding core and the winding band spool with a drive which is arranged in the wind-up station.

Advantageous constructions for the drive of the winding core and the wound product package and the winding band spool or reel will be discussed in greater detail hereinafter.

The unwinding or unreeling of the printed products from the wound product packages occurs in an unwinding station which is quite similar to the wind-up station. Here also advantageous constructions of such unwinding station will be described in greater detail hereinafter.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 2 is a side view of the mobile storage unit used in the arrangement shown in FIG. 1;

FIG. 5 is a cross-sectional view of the arrangement depicted in FIG. 1, taken substantially along the line V—V thereof;

DETAILED DESCRIPTION OF THE PREFERRED EMBODIMENTS

Figure 1:
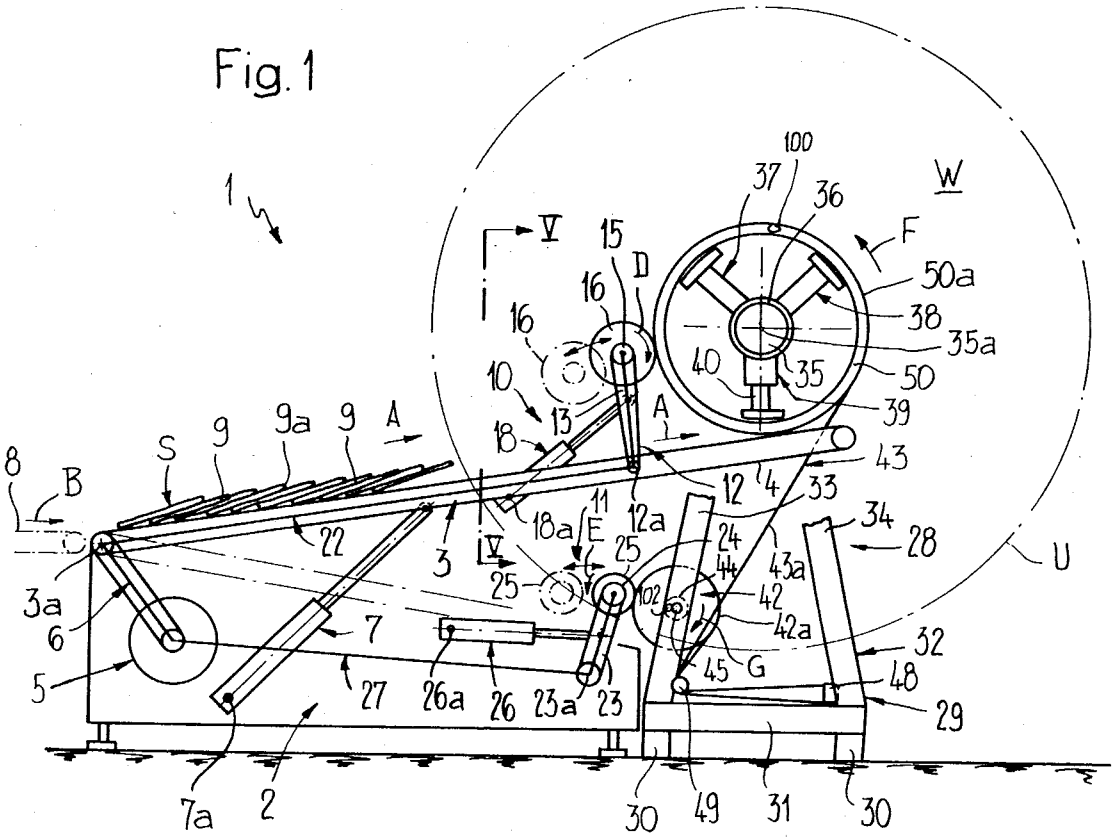
FIG. 1 schematically illustrates in side view a wind-up station equipped with a mobile storage unit and constructed according to the present invention.

Describing now the drawings, it is to be understood that to simplify the showing thereof, only enough of the structure of the processing apparatus and the related mobile storage unit has been illustrated therein as is needed to enable one skilled in the art to readily understand the underlying principles and concepts of the present development. Turning attention now specifically to FIG. 1 of the drawings, there has been depicted therein in side view and only purely in schematic illustration a wind-up station 1 which will be seen to comprise a stationary frame or frame unit 2 in which there is mounted a rocker or balance or balance arm or structure 3. This rocker or balance structure 3 is pivotable at one end thereof about the pivot axis or shaft designated by reference character 3*a*. In this rocker or balance structure 3 there is arranged a band or belt conveyor 4 or equivalent structure. This band or belt conveyor 4 is driven in the direction of the arrow A by a suitable drive motor 5 which is accommodated in the frame or frame unit 2. The appropriate drive connection between the drive motor 5 and the band or belt conveyor 4 has been generally indicated by reference character 6. Operatively engaging at one end with the rocker or balance structure 3 is a piston-and-cylinder unit 7 which is pivotably mounted in the frame or frame unit 2 at its opposite end about the pivot axis or pivot means or shaft 7*a*. Arranged upstream or forwardly of the rocker or balance structure 3 is a band or belt conveyor 8 which is appropriately driven in the direction of the arrow B. By means of this band or belt conveyor 8 the printed products 9, arriving in an imbricated formation S, are delivered and transferred to the band or belt conveyor 4. As particularly well recognized by further reverting to FIG. 1, within the imbricated formation S of the printed products 9 each such printed product 9 bears upon the immediately preceding or leading printed product 9, so that the leading edges 9*a*, which in the embodiment under discussion are constituted for instance by the fold edges or folds, are located at the top in the imbricated formation S of such printed products 9.

Also belonging to the wind-up station 1 are two drive arrangements or drive means 10 and 11. The drive arrangement or drive means 10, the construction of which will be readily apparent from FIG. 5, comprises a pivotable frame or frame member 12 which is pivotably mounted in the rocker or balance structure 3 about the pivot axis or shaft 12a. The pivotable frame or frame member 12 possesses two arms or arm members 13 and 14 arranged laterally of the band or belt conveyor 4, and these arms or arm members 13 and 14 carry at their free ends a shaft or shaft member 15 (FIG. 5). A drive roll or roller 16 constructed as a friction wheel or equivalent structure is seated upon this shaft or shaft member 15. A bolt or bolt member 17, aligned with the shaft 15, protrudes laterally from the arm or arm member 14. Engaging at the bolt 17 is a piston-and-cylinder unit 18. This piston-and-cylinder unit 18 is pivotably mounted at the rocker or balance structure 3 about the pivot axis or shaft 18*a*. At the side located opposite the bolt 17 the shaft 15 is connected with a sprocket wheel 19 which is in drive connection by means of a chain 20 with a sprocket wheel 21 rotatably mounted at the rocker or balance structure 3. This sprocket wheel 21 is driven by the drive motor 5 by means of any suitable and thus here only schematically depicted drive connection 22.

The other drive arrangement or drive means 11 is constructed similar to the drive arrangement or drive means 10 and likewise possesses a pivotable frame or frame member 23 which is pivotably mounted in the frame 2 about the pivot axis or shaft 23*a*. This pivotable frame or frame member 23 possesses a shaft or shaft member 24 upon which there is seated a drive roll or roller 25 likewise constructed as a friction wheel or equivalent structure. Operatively engaging with the pivotable frame 23 is a piston-and-cylinder unit 26 which is pivotably mounted at the frame 2 about the pivot axis or shaft 26*a*. The shaft 24 and thus also the drive roll or roller 25 are likewise driven by the drive motor 5. The drive connection suitable for this purpose has been schematically indicated by reference character 27.

As shown in FIG. 1 in the wind-up station 1 there is located a mobile storage or storing unit 28, the constructional details of which will be apparent from FIGS. 2 to 6 inclusive. This mobile storage unit 28 possesses a transportable frame or frame member 29 which is provided with feet or legs 30 which are mounted at the under side of a base plate or plate member 31. There is connected with this base plate 31 an upright, essentially vertical support or support member 32 which is constituted by two carriers or support elements 33 and 34 which mutually enclose an acute angle. At the upper end of this support or support member 32 there is connected therewith a shaft 35 which protrudes from the support or support member 32 essentially in horizontal direction. Upon the shaft or shaft member 35 there is rotatably mounted a sleeve or sleeve member 36. At the sleeve 36 there are secured three radially protruding or radially extending support arms or arm members 37, 38 and 39. One of these support arms 37, 38 and 39, here the support arm 39 is provided with an extendable and retractable support or support member 40.

In the carrier or support element 33 there is provided an opening 41 in which there is accommodated a winding band spool or reel 42 for a winding band or strap 43. The winding band spool or reel 42 is seated by means of its spool core 44 upon a bearing or mounting bolt or shaft 45 or equivalent structure which piercingly extends through the opening 41 and which is detachably mounted in the carrier or support element 33. At the carrier or support element 33 and at the base plate 31 there are rotatably mounted deflection rolls or rollers 46, 47, 48 and 49 over which there is guided the winding band or strap 43. This winding band or strap 43 extends from the winding band spool 42 to a hollow substantially cylindrical winding core or mandrel 50 which is constructed as a sleeve or sleeve member. This winding core 50 is retained by the support arms 37, 38 and 39. The support arms 37, 38 and 39 engage at the inner side or surface of the winding core 50.

Figure 3:
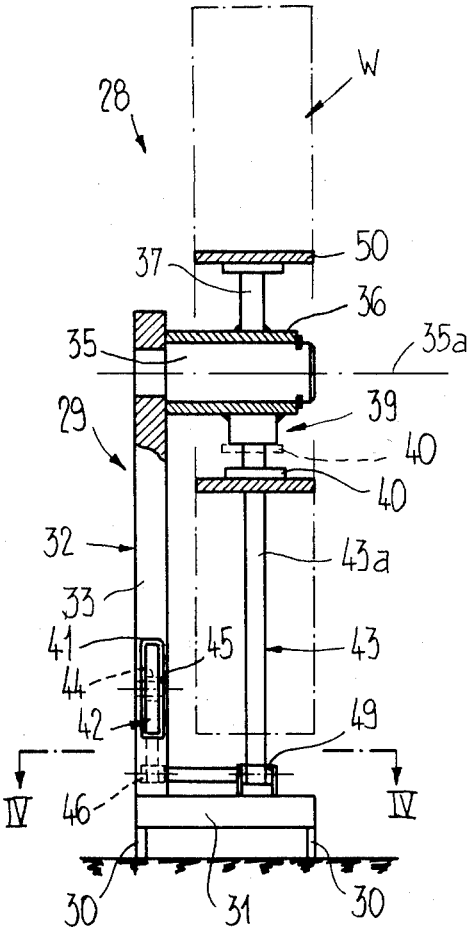
FIG. 3 illustrates in front view and partially in sectional view details of the mobile storage unit.
Figure 4:
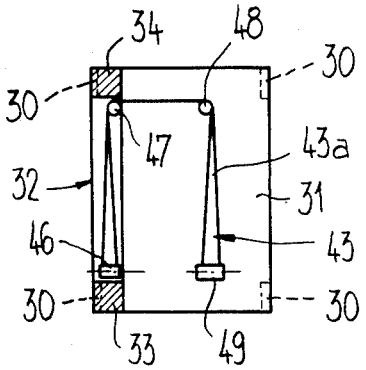
FIG. 4 is a cross-sectional view of the mobile storage unit depicted in FIG. 3, taken substantially along the line IV—IV.

As particularly evident by referring to FIG. 3, the winding band spool or reel 42 is laterally offset in relation to the winding core 50. By deflecting the winding band section or portion 43*a* located between the winding band spool 42 and the winding core 50 by means of the deflection rolls or rollers 46, 47, 48 and 49 this winding band section or portion 43*a* is brought into a position in which it is aligned approximately at the center of the winding core 50 and can travel onto the central region or center of the winding core 50, as the same has been depicted in FIGS. 3 and 5.

Before a mobile storage or storing unit 28 is mounted in the wind-up station 1 there is mounted upon the support arms 37, 38 and 39 an empty winding core or mandrel 50. For this purpose the support or support member 40 is retracted, the empty winding core 50 is placed upon both of the other support arms 37 and 38 and then the support or support member 40 is extended or thrusted out to such an extent until the winding core 50 is clamped by the support arms 37, 38 and 39 and can co-rotate together with the sleeve or sleeve member 36. Furthermore, a full winding band spool or reel 42 is mounted in the opening 41 and this full winding band spool 42 is freely rotatably seated upon the bearing or mounting bolt or bolt member or shaft 45. Thereafter the winding band or strap 43 is guided over the deflection rolls or rollers 46, 47, 48 and 49 and operatively connected with the winding core 50.

When the thus prepared mobile or transportable storage unit 28 is located in the wind-up station 1 then, by actuating the piston-and-cylinder units 18 and 26, the drive rolls or rollers 16 and 25 are pivoted or rocked until they come to bear at the outer surface or circumference 50*a* of the winding core 50 and at the outer surface or circumference 42*a* of the winding band spool 42, respectively. As a result, the drive roll or roller 16 of the drive arrangement or drive means 10 comes into contact with the outermost coil or layer of the winding band or strap 43 which has already been wound upon the winding core 50, as such has been depicted in FIG. 5. By means of the drive motor 5 there is driven, on the one hand, the band or belt conveyor 4 and, on the other hand, the drive rolls or rollers 16 and 25, and specifically in the direction D (drive roll 16) and in the direction E (drive roll 25). The rotational movement of the drive rolls or rollers 16 and 25, by virtue of the frictional contact wtih the winding band 43 and the winding band spool 42, respectively, produce the effect that the winding core or mandrel 50 is rotated in the direction of the arrow F and the winding band spool or reel 42 is rotated in the direction of the arrow G. The imbricated formation S of the printed products 9 which is infed by the band or belt conveyor 4 is thus wound up in conjunction with the winding band or strap 43 onto the winding core 50. This wind-up operation is accomplished basically in the manner taught in Swiss Patent No. 642,602 and the cognate U.S. Pat. No. 4,438,618, granted Mar. 27, 1984.

So that the winding band or strap 43 travels while in a tensioned state onto the winding core 50 or, as the case may be, onto the wound product package W which is being formed thereupon, the winding band spool 42 is driven with a circumferential speed or velocity by the drive arrangement or drive means 11 which is somewhat smaller than the circumferential speed or velocity of the winding core 50 or, as the case may be, the wound product package W forming thereupon. The conveying speed of the band or belt conveyor 4 approximately corresponds to the circumferential velocity of the winding core 50 or, as the case may be, the wound product package W. This wound product package W is somewhat constricted or crimped at the region of the winding band or strap 43. Since, as already mentioned, the drive roll 16 engages in each case at the momentarily outermost coil or layer of the wound-up winding band or strap 43, the driving of the wound product package W is accomplished at a spacing or distance from the rotational axis 35a of the wound product package W and which spacing or distance is somewhat smaller than the radius of the wound product package externally of the region of the winding band or strap 43.

As already explained, both of the drive rolls 16 and 25 are driven by one and the same drive motor or drive means 5. This drive motor 5 also drives the band or belt conveyor 4. The drive connections 22 and 27 between the drive motor 5 and the drive rolls or rollers 16 and 25 do not contain any slip couplings, winding transmissions or gearings and the like.

Once the wound product package W has reached its final or desired package size, then the winding band or strap 43 is still wrapped a number of times about the finished or completely wound product package W. The drive rolls 16 and 25 are again lifted off the outer surface or circumference U of the wound product package W and the outer surface or circumference 42*a* of the widing band spool or reel 42 by the action of the piston-and-cylinder units 18 and 26, respectively. Then the mobile storage unit 28 is removed from the wind-up station 1 and replaced by a new mobile storage unit 28 which has been prepared in the described manner and upon whose winding core 50 there is then wound-up new printed products 9.

At the mobile storage or storing unit 28 which has been removed from the wind-up station 1 there is now retracted the support or support member 40 and thus the winding core 50 together with the wound product package W is released from the entrainment connection with the support arms 37, 38 and 39. By retracting the bearing or mounting bolt or shaft 45 the winding band spool 42 is released for its removal out of the associated opening 41. The winding core 50 together with the winding band spool or reel 42 containing the remaining length of the winding band or strap 43 are now removed from the frame or frame member 29 and brought to an intermediate storage. If the entire winding band or strap 43 has been wound-up, then the empty spool core 44, separated from the wound product package W is available for further use.

Figure 6:
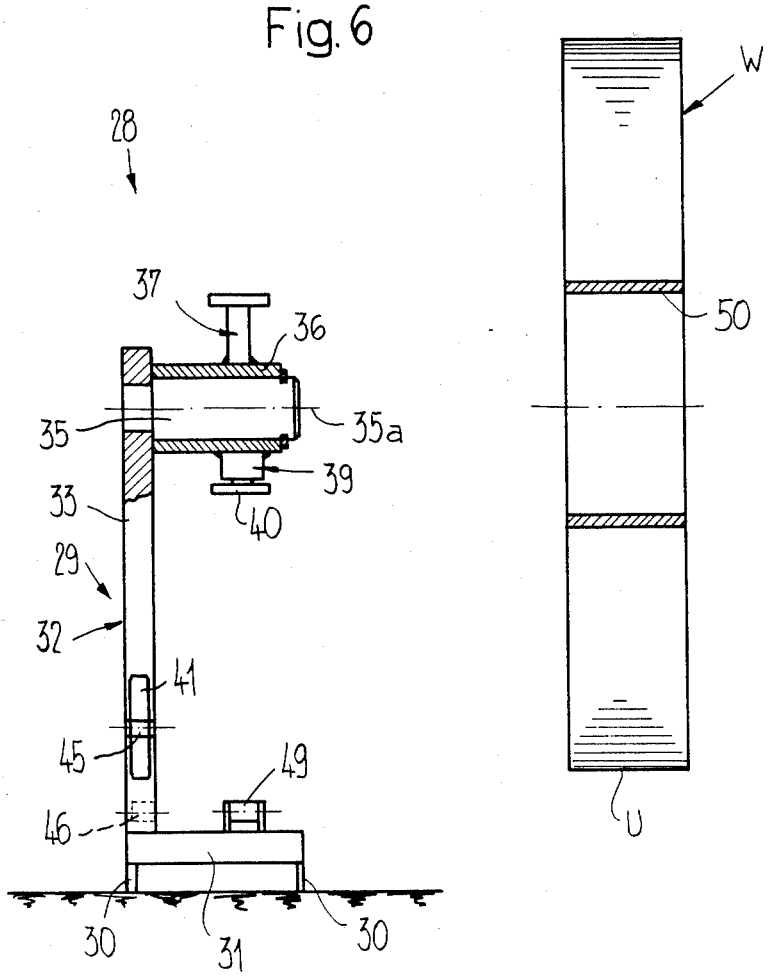
FIG. 6 is an illustration of a mobile storage unit, corresponding to the showing of FIG. 3, depicting such mobile storage unit with the wound product package removed as well as the winding band spool or reel likewise removed.

In FIG. 6 there has been depicted the mobile storage unit 28 after the removal of the wound product package W and the winding band spool 42. This mobile storage unit 28 is now ready for being newly employed or utilized, thus, for instance, for taking-up an empty winding core 50 and a full winding band spool or reel 42 in order to be again used for the formation of a new wound product package W.

Figure 7:
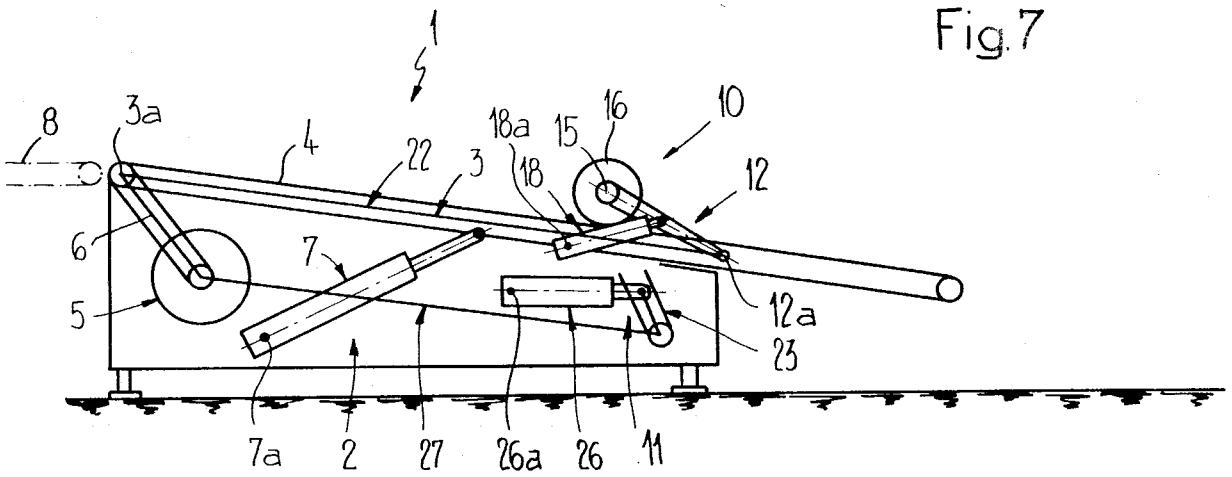
FIG. 7 illustrates a wind-up station in its non-operative state or mode and without the mobile storage unit operatively coupled thereat.

In FIG. 7 there has been depicted the wind-up station 1 in its non-operational mode where there has not been operatively coupled thereat any mobile storage unit 28. The piston-and-cylinder units 7, 18 and 26 are located in their retracted state. For the same or analogous individual components there have been conveniently utilized the same reference characters as employed in conjunction with the arrangement of FIG. 1.

Figure 8:
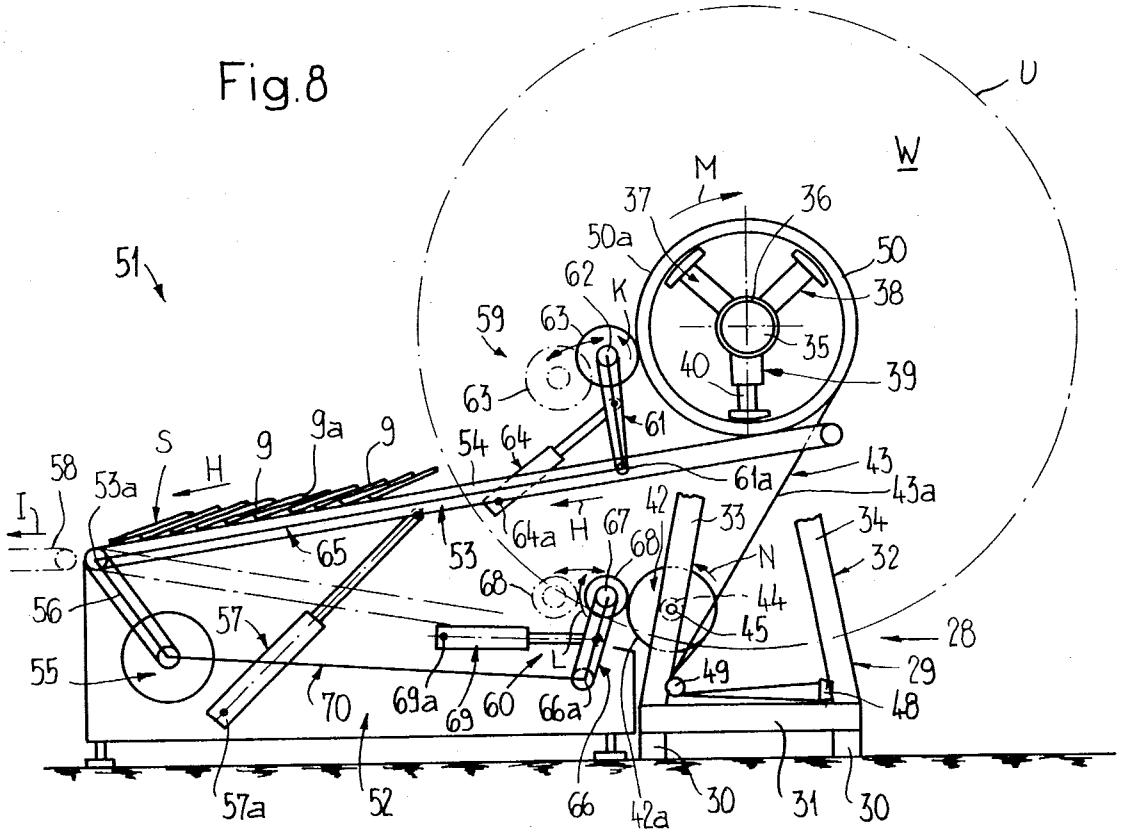
FIG. 8 is a side view of an unwinding station.

For unwinding the printed products 9 from the wound product packages W there is provided an unwinding or unreeling station 51, which has been particularly depicted in FIG. 8. This unwinding station 51 is quite similar in its construction to the wind-up station 1 and likewise possesses a stationary frame or frame member 52 in which there is pivotably mounted a rocker or balance arm or balance structure 53 or equivalent structure for pivotable movement about a pivot axis or shaft 53*a*. In this rocker or balance structure 53 there travels a band or belt conveyor 54 which is driven in the direction of the arrow H by a drive motor 55 accommodated in the frame or frame member 52. The corresponding drive connection has been designated by reference character 56. At the rocker or balance structure 53 there engages a piston-and-cylinder unit 57 which is pivotably mounted at the frame or frame member 52 about the pivot axis or shaft 57*a*. Arranged after or downstream of the rocker or balance structure 53 is a band or belt conveyor 58, the conveying direction of which has been designated by reference character I.

The unwinding station 51 possesses two drive arrangements or drive means 59 and 60 which are of similar construction as the drive arrangements or drive means 10 and 11 of the wind-up station 1. Consequently, the drive arrangement or drive means 59 possesses a pivotable frame or frame member 61 which is pivotably mounted in the rocker or balance structure 53 about the pivot axis or shaft 61*a*. This pivotable frame or frame member 61 possesses a shaft 62 upon which there is seated a drive roll or roller 63 constructed as a friction wheel or equivalent structure. At the frame or frame member 61 there engages a piston-and-cylinder unit 64 which is pivotably secured at the rocker or balance structure 53 for pivotal movement about the pivot axis or shaft 64*a*. The drive roll 63 is driven by the drive motor 55 through the here only schematically depicted but conventional drive connection 65.

The other drive arrangement or drive means 60 likewise possesses a pivotable frame or frame member 66 which is pivotably mounted at the frame 52 for pivotal movement about the pivot axis or shaft 66*a*. The pivotable frame 66 possesses a shaft 67 upon which there is seated a drive roll or roller 68 constructed as a friction wheel or equivalent structure. At the pivotable frame 66 there engages a piston-and-cylinder unit 69 which is pivotably mounted at the frame 52 so as to be pivotable about the pivot axis or shaft 69*a*. The drive roll 68 is driven by the drive motor 55 by the drive connection generally indicated by reference character 70.

The drive rolls or rollers 63 and 68, in contrast to the drive rolls or rollers 16 and 25 of the wind-up station 1, are driven in the opposite rotational direction or sense, namely in the direction of the arrow K (drive roll 63) and the arrow L (drive roll 68). These drive rolls 63 and 68 likewise engage at the outer surface or circumference U of the wound product package W and at the outer surface or circumference 42*a* of the winding band spool 42, respectively. This means that the wound product package W is rotated in the direction of the arrow M and the winding band spool 42 is rotated in the direction of the arrow N. Just as was the case for the wind-up station 1 previously described, the drive roll or roller 63 engages in each case with the momentary outermost layer or coil of the winding band or strap 43 which has been wound upon the wound product package W. The drive of the wound product package W and the winding band spool or reel 42 is accomplished essentially in the same manner as described previously with respect to the wind-up or winding-up operation. Nonetheless the wound product package W is driven at a circumferential speed or velocity which is somewhat less than the circumferential speed or velocity of the winding band spool 42 in order to maintain the winding band or strap 43 tensioned during the unwinding operation.

For unwinding the printed products 9 from a wound product package W the latter is mounted in an empty mobile storage or storing unit 28. In so doing the winding core 50 is placed upon the support arms or arm members 37 and 38, whereupon the support or support member 40 is extended or thrusted out and the winding core 50 is clamped. Then the free winding band end is connected with the spool core 44 which is mounted upon the bearing or mounting bolt or shaft 45 or equivalent structure. As a result the mobile storage unit 28 is ready for accomplishing the unwinding or unreeling operation.

The thus prepared mobile or transportable storage unit 28 is brought to the unwinding station 51, whereupon the drive rolls 63 and 68 are brought into contact with the wound product package W and the winding band spool 42, respectively. By driving the winding band spool 42 the winding band 43 is wound-off of the wound product package W, and at the same time the imbricated formation S of printed products 9 is also unwound and outfed by means of the band or belt conveyor 54 and then transferred to the band or belt conveyor 58. In the unwound imbricated formation S each printed product 9 no longer bears upon the preceding printed product, rather upon the trailing printed product. This means that the edges 9*a*, which constituted the leading product edges prior to the winding-up operation, now constitute the trailing edges.

As soon as all of the printed products 9 have been unwound, then the now empty mobile storage unit 28 is removed from the unwinding station 51 and replaced with a loaded mobile storage unit 28 which is then emptied in the aforedescribed manner.

The emptied mobile storage unit 28 can now be directly brought to a wind-up station 1 since it is basically ready for winding-up printed products. However, it is also possible to remove the empty winding core 50 and the full winding band spool 42 and to load the mobile storage unit 28 once again with a finalized or full wound product package W and an empty spool core 44 or, as the case may be, the winding band spool 42 belonging to such wound product package W.

Apart from the foregoing there also of course is available the possibility, after completion of a wound product package W, not to remove such from the mobile storage unit 28, rather to transport this mobile storage unit 28 together with the wound product package W and the winding band spool 42 directly to an unwinding station 51 or to an intermediate storage or storage area. In such case there must be prevented that the winding band 43 can loosen or unravel, since otherwise there exists the danger of disintegration or falling apart of the wound product package W. Therefore there must be provided at the mobile storage unit 28 means for blocking the winding band spool 42 and the wound product package W, so that such cannot rotate in the sense of unwinding the wound product package W and the thereon wound winding band 43. Such blocking means 100 and 102 (see FIG. 1) can be constituted by, for instance, insertable bolts or pin members or equivalent structure which engage at the winding core 50 and at the spool core 44, respectively, brake devices or the like.

As particularly evident by referrinng to FIG. 6, the mobile storage units 28 are quite simple in construction, since only mounting or support means 35 to 40 and 45 need be provided for the removable mounting of the winding cores 50 and the winding spools 42 as well as deflection rolls or rollers 46 to 49. Contributing to the simple constructional design is furthermore the fact that the winding band spool 42 is mounted in the carrier or support element 33. Thus there can be realized a saving in a separate support for mounting the winding band spool 42.

Since the winding core 50 or, as the case may be, the wound product package W and the winding band spool 42 are driven in the described manner at their outer surface or circumference 50a and U and 42*a*, respectively, there are not required at the mobile storage unit 28 any coupling devices for coupling the stationary drives.

The mobile storage units 28 are continuously capable of being placed into operation or used, since the wound product packages W and the winding band spools 42 can be removed and the mobile storage units 28 thus need not of necessity remain blocked in an intermediate storage or storage area.

By virtue of the fact that the drive of the winding core 50 or, as the case may be, the wound product package W and the winding spools 42 is accomplished by drive rolls or rollers engaging at the corresponding outer surface or circumference thereof, the drive arrangements or drive means 10, 11 and 59, 60 can be of very simple design. Slip couplings or clutches, winder or winding transmissions or gearing units and the like are not needed.

Since the drive rolls or rollers 16 and 63 of the drive arrangements 10 and 59, respectively, engage at the winding band or strap 43 and not at the printed products 9, there is no danger of damage to such printed products 9.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for processing printed products, such as newspapers, periodicals and the like, arriving in an imbricated formation, comprising:

a plurality of mobile storage units;

each of said mobile storage units comprising:

a frame;

a hollow substantially cylindrical winding core rotatably mounted in said frame;

a winding band spool for a winding band connectable with said hollow substantially cylindrical winding core;

said winding band spool being rotatably mounted in said frame;

at least one stationary wind-up station;

a respective one of said mobile storage units being operatively coupled with said stationary wind-up station;

said wind-up station being provided with infeed means for infeeding printed products to the hollow substantially cylindrical winding core and to a wound product package which is being formed thereon;

a first drive arrangement provided for said winding station for rotating said hollow subtantially cylindrical winding core and the wound product package formed upon said hollow substantially cylindrical winding core;

means for detachably mounting said hollow substantially cylindrical winding core at the frame of each mobile storage unit; and means for detachably mounting the winding band spool at the frame of each mobile storage unit.

2. The apparatus as defined in claim 1, further including:

a second drive arrangement provided for said wind-up station for rotating the winding band spool;

said second drive arrangement serving for driving the winding band spool at a circumferential speed which is less than the circumferential speed of the wound product package.

3. The apparatus as defined in claim 1, wherein:

said first drive arrangement engages at the circumference of the hollow substantially cylindrical winding core and the circumference of the wound product package formed thereupon.

4. The apparatus as defined in claim 2, wherein:

said second drive arrangement engages with the circumference of the winding band spool.

5. The apparatus as defined in claim 4, wherein:

said first drive arrangement comprises a drive roll contactable with the circumference of the winding core and the wound product package formed thereupon; and said second drive arrangement comprises a drive roll contactable with the circumference of the winding band spool.

6. The apparatus as defined in claim 5, further including:

common drive means for rotatably driving both of said drive rolls.

7. The apparatus as defined in claim 5, wherein:

said drive roll for said first drive arrangement engages at the winding band wound upon the winding core and upon the wound product package formed upon the winding core.

8. The apparatus as defined in claim 7, further including:

a pivot mechanism provided for the drive roll of the first drive arrangement;

a pivot mechanism provided for the drive roll of the second drive arrangement;

the pivot mechanism for the drive roll of the first drive arrangement pivoting said drive roll from an inoperative position into an operative position in which such drive roll engages with the circumference of the winding core and the wound product package formed upon such winding core; and said pivot mechanism for the drive roll of the second drive arrangement pivoting said drive roll from an inoperative position into a drive position in which said drive roll engages with the winding band spool.

9. The apparatus as defined in claim 1, further including:

at least one stationary unwinding station;

one of mobile storage units supporting a wound product package being operatively associated with said at least one stationary unwinding station;

outfeed means provided for said stationary unwinding station for outfeeding unwound printed products; and a first drive means provided for the stationary unwinding station and intended to engage at the circumference of the winding band spool.

10. The apparatus as defined in claim 9, further including:

a second drive means provided for the unwinding station and intended to engage at the circumference of the wound product package for rotating the wound product package at a circumferential speed which is less than the circumferential speed of the winding band spool.

11. The apparatus as defined in claim 10, wherein:

said first drive means comprises a drive roll which can be placed into contact with the circumference of the winding band spool; and said second drive means comprises a drive roll which can be placed into contact with the circumference of the wound product package.

12. The apparatus as defined in claim 11, further including:

common drive means for rotatably driving both of said drive rolls.

13. The apparatus as defined in claim 11, wherein:

said drive roll of the second drive means is intended to contactingly engage at the winding band which is wound-up upon the wound product package.

14. The apparatus as defined in claim 1, wherein:

said means for detachably mounting said hollow substantially cylindrical winding core comprises first mounting means for the removable mounting of the winding core; and said means for detachably mounting said winding band spool comprises second mounting means for the removable mounting of the winding band spool.

15. The apparatus as defined in claim 14, wherein:

each said hollow substantially cylindrical winding core possesses an inner surface;

each said frame comprises a substantially upright support means;

each said mobile storage unit further comprising:

a shaft member extending in substantially horizontal direction mounted at said substantially upright support means;

a sleeve member freely rotatably mounted upon said shaft member; and said sleeve member being provided with radially protruding support arms intended to engage at the inner surface of the winding core.

16. The apparatus as defined in claim 15, wherein:

said second mounting means for the winding band spool is provided in the support means.

17. The apparatus as defined in claim 16, wherein:

said support means possesses an opening for the reception of the winding band spool.

18. The apparatus as defined in claim 17, further including:

a mounting shaft for the winding band spool piercingly extending through said opening.

19. The apparatus as defined in claim 18, wherein:

said mounting shaft is removably mounted in said opening.

20. The apparatus as defined in claim 16, wherein:

said winding band spool is laterally offset with respect to the hollow substantially cylindrical winding core and the wound product package formed thereupon; and deflection roll means provided at said frame for the deflection of a section of the winding band which extends between the winding band spool and the hollow substantially cylindrical winding core and the wound product package formed thereupon.

21. The apparatus as defined in claim 14, further including:

means for blocking the hollow substantially cylindrical winding core and the wound product package formed thereupon.

22. The apparatus as defined in claim 14, further including:

means for blocking the hollow substantially cylindrical winding band spool.

* * * * *